US009123275B2

(12) United States Patent
Yang et al.

(10) Patent No.: US 9,123,275 B2
(45) Date of Patent: Sep. 1, 2015

(54) METHOD FOR DISPLAYING ERROR RATES OF DATA CHANNELS OF DISPLAY

(71) Applicant: Novatek Microelectronics Corp., Hsinchu (TW)

(72) Inventors: Shun-Hsun Yang, Hsinchu (TW); Chia-Wei Su, Hsinchu (TW); Po-Yu Tseng, Taoyuan County (TW); Po-Hsiang Fang, Hsinchu (TW); Hsin-Hung Lee, Kaohsiung (TW)

(73) Assignee: Novatek Microelectronics Corp., Hsinchu (TW)

( * ) Notice: Subject to any disclaimer, the term of this patent is extended or adjusted under 35 U.S.C. 154(b) by 255 days.

(21) Appl. No.: 13/778,122

(22) Filed: Feb. 27, 2013

(65) Prior Publication Data

US 2014/0049524 A1 Feb. 20, 2014

(30) Foreign Application Priority Data

Aug. 14, 2012 (TW) ..... 101129425 A

(51) Int. Cl.
*G09G 3/00* (2006.01)
*G09G 3/36* (2006.01)

(52) U.S. Cl.
CPC ..... *G09G 3/006* (2013.01); *G09G 3/3688* (2013.01); *G09G 2330/12* (2013.01); *G09G 2370/08* (2013.01)

(58) Field of Classification Search
CPC ..... G09G 3/00; G09G 3/006; G09G 3/3688; G09G 3/3648; G09G 5/00
USPC ..... 345/204, 214, 690
See application file for complete search history.

(56) References Cited

U.S. PATENT DOCUMENTS

| | | | | |
|---|---|---|---|---|
| 8,878,828 | B2 * | 11/2014 | Baek et al. | 345/204 |
| 8,963,937 | B2 * | 2/2015 | Yang | 345/534 |
| 2002/0008684 | A1 | 1/2002 | Udo et al. | |
| 2004/0012580 | A1 * | 1/2004 | Yamagishi et al. | 345/204 |
| 2006/0244743 | A1 * | 11/2006 | Tanaka et al. | 345/204 |
| 2008/0309605 | A1 | 12/2008 | Jang et al. | |
| 2009/0201231 | A1 * | 8/2009 | Takahara et al. | 345/76 |
| 2009/0267877 | A1 | 10/2009 | Yen et al. | |
| 2011/0137603 | A1 * | 6/2011 | Dimitriev-Zdorov | 702/117 |
| 2012/0146965 | A1 | 6/2012 | Baek et al. | |
| 2013/0036335 | A1 * | 2/2013 | Kim et al. | 714/704 |
| 2013/0044101 | A1 * | 2/2013 | Kim et al. | 345/419 |
| 2013/0113777 | A1 * | 5/2013 | Baek et al. | 345/212 |

* cited by examiner

*Primary Examiner* — Joe H Cheng
(74) *Attorney, Agent, or Firm* — Jianq Chyun IP Office

(57) ABSTRACT

A method for displaying error rates of data channels of a display is provided. A timing controller of the display repeatedly transmits a test signal with a specific format to a first and a second source drivers of the display via a first and a second data channels of the display. During testing, a first number and a second number of times of the first source driver and the second source driver determining that the received test signal does not have the specific format are counted respectively. The first and the second source drivers control displaying of a first area and a second area of a panel of the display respectively according to the counted first and second numbers of times. Accordingly, the error rates of the data channels are presented on the panel of the display in a way that the error rates could be recognized more easily.

14 Claims, 14 Drawing Sheets time
$T_1$
$T_S$
$T_0$
$S_T$ $S_T$ $S_T$ $

METHOD FOR DISPLAYING ERROR RATES OF DATA CHANNELS OF DISPLAY

CROSS-REFERENCE TO RELATED APPLICATION

This application claims the priority benefit of Taiwan application serial no. 101129425, filed on Aug. 14, 2012. The entirety of the above-mentioned patent application is hereby incorporated by reference herein and made a part of this specification.

BACKGROUND OF THE INVENTION

1. Field of the Invention

The invention relates to a method for displaying error rates of data channels of a display, and more particularly, to a method for displaying error rates of data channels of a display in a way that the error rates are easily recognized.

2. Description of Related Art

In recent years, display panel technology has matured. In addition, display panels continue to increase in both size and resolution to meet consumer demands. However, when the resolution and size of a display panel are increased, the operating frequency inside the display panel also becomes higher. A conventional transmission system in a display panel has to be disposed with a plurality of data channels such that it is difficult to enable all the data channels to have similar electrical characteristics in a high-frequency environment. Thus no effective correction mechanism for correcting the foregoing problem can be easily provided by a source driver, and accordingly the error rates of the data channels are hard to reduce. More importantly, additional cost is incurred particularly for resolving the foregoing problem in the system so that product competitiveness cannot be improved.

SUMMARY OF THE INVENTION

The invention provides a method for displaying error rates of data channels of a display. The method is by transmitting a test signal with a specific format to a plurality of source drivers of a display so that the source drivers determine the error rates of a plurality of data channels of the display according to the received test signal and control a panel of the display to present the error rates of the data channels in a way that the error rates are easily recognized.

The invention provides a method for displaying error rates of data channels of a display. The method includes, by a timing controller of the display, repeatedly transmitting the test signal with the specific format to a first and a second source drivers of the display via a first and a second data channels of the display. The method also includes, by the first and the second source drivers, receiving the test signal respectively from the first and the second data channels, and determining if the received test signal has the specific format. The method further includes, during a testing period, counting respectively a first number and a second number of times of the first source driver and the second source driver determining that the received test signal does not have the specific format. The method additionally includes, by the first source driver, controlling displaying of a first area of the panel of the display according to the counted first number of times. The method includes also, by the second source driver, controlling displaying of a second area of the panel according to the counted second number of times.

In an embodiment of the invention, the first area includes a first sub-area and a second sub-area, and the second area includes a third sub-area and a fourth sub-area. The first source driver controls a size of the first sub-area according to the counted first number of times, and the second source driver controls a size of the third sub-area according to the counted second number of times.

In an embodiment of the invention, an area ratio between the first sub-area and the third sub-area is equal to a ratio of the counted first number of times to the counted second number of times.

In an embodiment of the invention, the first source driver controls the first sub-area and the second sub-area to be displayed with different gray-level values, and the second source driver controls the third sub-area and the fourth sub-area to be displayed with different gray-level values.

In an embodiment of the invention, the first source driver controls the first sub-area to be displayed with graded gray-level values, and the second source driver controls the third sub-area to be displayed with graded gray-level values.

In an embodiment of the invention, the panel includes a plurality of pixels and a plurality of data lines. The first and the second source drivers are coupled to the pixels via the data lines. The first source driver controls displaying of the first sub-area during a first display period according to the counted first number of times. The second source driver controls displaying of the third sub-area during a second display period according to the counted second number of times. A ratio of the first display period to the second display period is equal to the ratio of the counted first number of times to the counted second number of times.

In an embodiment of the invention, the panel includes a plurality of pixels and a plurality of data lines. The first source driver controls a first number of the data lines according to the counted first number of times to control displaying of the first sub-area. The second source driver controls a second number of the data lines according to the counted second number of times to control displaying of the third sub-area. A ratio of the first number to the second number is equal to the ratio of the counted first number of times to the counted second number of times.

In an embodiment of the invention, the first source driver controls a color displayed by the first area according to the counted first number of times, and the second source driver controls a color displayed by the second area according to the counted second number of times.

In an embodiment of the invention, the first source driver controls the first sub-area to be displayed with graded color-level values, and the second source driver controls the third sub-area to be displayed with graded color-level values.

Based on the above, the invention is by transmitting a test signal with a specific format to a plurality of source drivers of a display so that the source drivers determine the error rates of the plurality of data channels of the display according to the received test signal and control a panel of the display to present the error rates of the data channels in a way that the error rates are easily recognized.

To make the aforementioned features and advantages of the invention more comprehensible, embodiments accompanied with figures are described in detail below.

DESCRIPTION OF EMBODIMENTS

Figure 1:
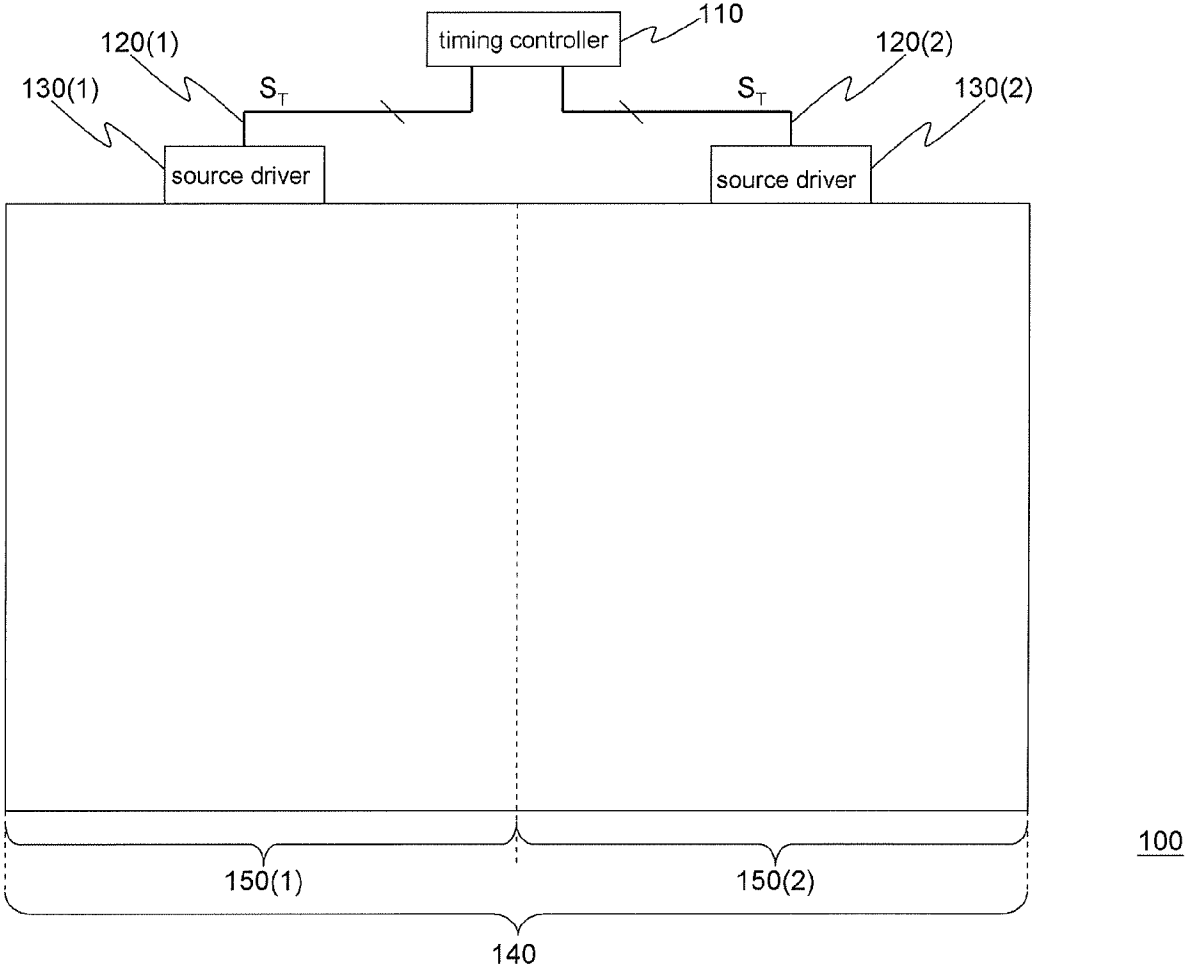
FIG. 1 is a schematic diagram of a display according to an embodiment of the invention.

Please refer to FIG. 1. FIG. 1 is a schematic diagram of a display 100 according to an embodiment of the invention. In this embodiment, the display 100 is a liquid crystal display, but the invention is not limited thereto. The invention is applicable to any type of display adopting a timing controller (TCON) for controlling driving and displaying of a source driver. The display 100 has a timing controller (TCON) 110, a first source driver 130(1), a second source driver 130(2) and a panel 140. For the convenience of illustration, only two source drivers are described in this embodiment. However, the invention is not limited thereto. This embodiment is applicable to displays having different numbers of source drivers. The timing controller 110 is used to generate a test signal $S_T$ and to generate a clock signal and a data signal for controlling operation of the display 100. The timing controller 110 is coupled respectively to the first source driver 130(1) and the second source driver 130(2) via a first data channel 120(1) and a second data channel 120(2).

The first data channel 120(1) and the second data channel 120(2) may be achieved by circuits such as transistor-transistor logic (TTL) circuits, differential input/output circuits, etc. In addition, methods for transmitting signals between the timing controller 110 and the two source drivers 130(1), 130(2) include point-to-point method, multi-drop method, clock-embedded method, etc.

In an embodiment of the invention, the clock signal and the data signal generated by the timing controller 110 for controlling operation of the display 100 are transmitted to the first source driver 130(1) and the second source driver 130(2) respectively via different transmission interfaces. The first data channel 120(1) and the second data channel 120(2) are respectively coupled to the different transmission interfaces for transmitting the clock signal and the data signal generated by the timing controller 110, so as to transmit the clock signal and the data signal generated by the timing controller 110 respectively to the first source driver 130(1) and the second source driver 130(2). In another embodiment of the invention, the clock signal generated by the timing controller 110 is included in the data signal generated by the timing controller 110. In one of the several embodiments, the first source driver 130(1) and the second source driver 130(2) include a clock and data recovery (CDR) circuit for processing the signals from the timing controller 110, so as to generate the clock and data for driving the panel 140.

In addition, the timing controller 110 repeatedly transmits the test signal $S_T$ to the first source driver 130(1) and the second source driver 130(2) via the first data channel 120(1) and the second data channel 120(2). The test signal $S_T$ is in a specific format, and the first source driver 130(1) and the second source driver 130(2) determine if the received test signal $S_T$ is in the specific format. In general, if no error occurs in the transmission of the test signal $S_T$ to the first data channel 120(1) and the second data channel 120(2), the test signal $S_T$ received by the first source driver 130(1) and the second source driver 130(2) is in the specific format. Nevertheless, in cases where the first data channel 120(1) and the second data channel 120(2) are too long due to oversizing of the panel, the test signal $S_T$ may fade or be interfered with during the transmission, such that the test signal $S_T$ received by the first source driver 130(1) and the second source driver 130(2) is not necessarily in the specific format. Therefore, by repeatedly transmitting the test signal $S_T$ in the specific format to the first source driver 130(1) and the second source driver 130(2), and by allowing the first source driver 130(1) and the second source driver 130(2) to respectively determine if the received test signal $S_T$ is in the specific format, the error rates of the first data channel 120(1) and the second data channel 120(2) are respectively calculated. In addition, in an embodiment of the invention, the test signal $S_T$ in the specific format is a secret key consisting of a series of bits. In addition, in an embodiment of the invention, the test signal $S_T$ in the specific format has a specific waveform.

Figure 2:
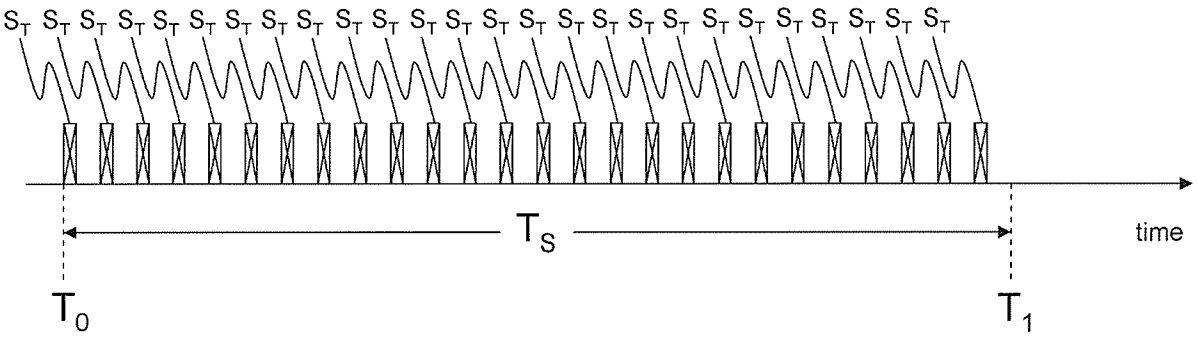
FIG. 2 is a timing diagram of the test signal in FIG. 1.

Please refer to FIG. 1 and FIG. 2. FIG. 2 is a timing diagram of the test signal $S_T$ in FIG. 1. The test signal $S_T$ is in the specific format, and in an embodiment of the invention, the test signal $S_T$ in the specific format is a secret key consisting of a series of bits. In another embodiment of the invention, the test signal $S_T$ in the specific format has a specific waveform. For example, in an embodiment, the timings of $S_T$ between T0 and T1, $S_{T(1)}$, $S_{T(2)}$, $S_{T(3)}$, $S_{T(4)}$, . . . $S_{T(N)}$ are specifically coded. It is possible that $S_{T(1)}=S_{T(2)}=S_{T(3)}=S_{T(4)}, \ldots =S_{T(N)}$ or that $S_{T(1)}\neq S_{T(2)}\neq S_{T(3)}\neq S_{T(4)}, \ldots \neq S_{T(N)}$.

During a testing period $T_S$, the timing controller 110 repeatedly transmits the test signal $S_T$ to the first source driver 130(1) and the second source driver 130(2) via the first data channel 120(1) and the second data channel 120(2). Herein, the testing period $T_S$ starts at a time $T_0$ and ends at a time $T_1$. In an embodiment of the invention, the timing controller 110 periodically transmits the test signal $S_T$ to the first source driver 130(1) and the second source driver 130(2) during the testing period $T_S$. In another embodiment of the invention, the timing controller 110 aperiodically transmits the test signal $S_T$ to the first source driver 130(1) and the second source driver 130(2) during the testing period $T_S$. In other words, the time interval between two adjacent transmissions of the test signal $S_T$ may be fixed or not fixed.

During the testing period $T_S$, the first source driver 130(1) and the second source driver 130(2) respectively count a first number and a second number of times the source drivers themselves determine that the received test signal $S_T$ is not in the specific format. For the convenience of illustration, it is assumed that the counted first number of times is equal to N1 and the counted second number of times is equal to N2. The first source driver 130(1) controls displaying of a first area 150(1) of the panel 140 according to the counted first number of times N1, and the second source driver 130(2) controls displaying of a second area 150(2) of the panel 140 according to the counted second number of times N2. For example, in an embodiment of the invention, the first source driver 130(1) controls the first area 150(1) to display the counted first number of times N1 as an Arabic numeral according to the counted first number of times N1, and the second source driver 130(2) controls the second area 150(2) to display the counted second number of times N2 as an Arabic numeral according to the counted second number of times N2. For another example, in an embodiment of the invention, the first source driver 130(1) controls a color displayed by the first area 150(1) according to the counted first number of times N1, and the second source driver 130(2) controls a color displayed by the second area 150(2) according to the counted second number of times N2.

In an embodiment of the invention, the first source driver 130(1) and the second source driver 130(2) set the colors displayed by the first area 150(1) and the second area 150(2) respectively according to the degrees of the error rates corresponding to the first data channel 120(1) and the second data channel 120(2). For example, when the counted first number of times N1 or the counted second number of times N2 is smaller than a first preset threshold value, the corresponding first source driver 130(1) or second source driver 130(2) drives the corresponding first area 150(1) or second area 150(2) to display green. When the counted first number of times N1 or the counted second number of times N2 is between the first preset threshold value and a second preset threshold value, the corresponding first source driver 130(1) or second source driver 130(2) drives the corresponding first area 150(1) or second area 150(2) to display yellow. Herein, the second preset threshold value is greater than the first preset threshold value. When the counted first number of times N1 or the counted second number of times N2 is greater than the second preset threshold value, the corresponding first source driver 130(1) or second source driver 130(2) drives the corresponding first area 150(1) or second area 150(2) to display red. Based on the above, a tester of the display 100 roughly determines the error rates corresponding to the first data channel 120(1) and the second data channel 120(2) according to the colors displayed by the first area 150(1) and the second area 150(2). It should be noted that the error rate of the first data channel 120(1) positively correlates to the counted first number of times N1, and the error rate of the second data channel 120(2) positively correlates to the counted second number of times N2. Thus, the counted first number of times N1 can be used to represent the error rate of the first data channel 120(1), and the counted second number of times N2 can be used to represent the error rate of the second data channel 120(2).

Figure 3:
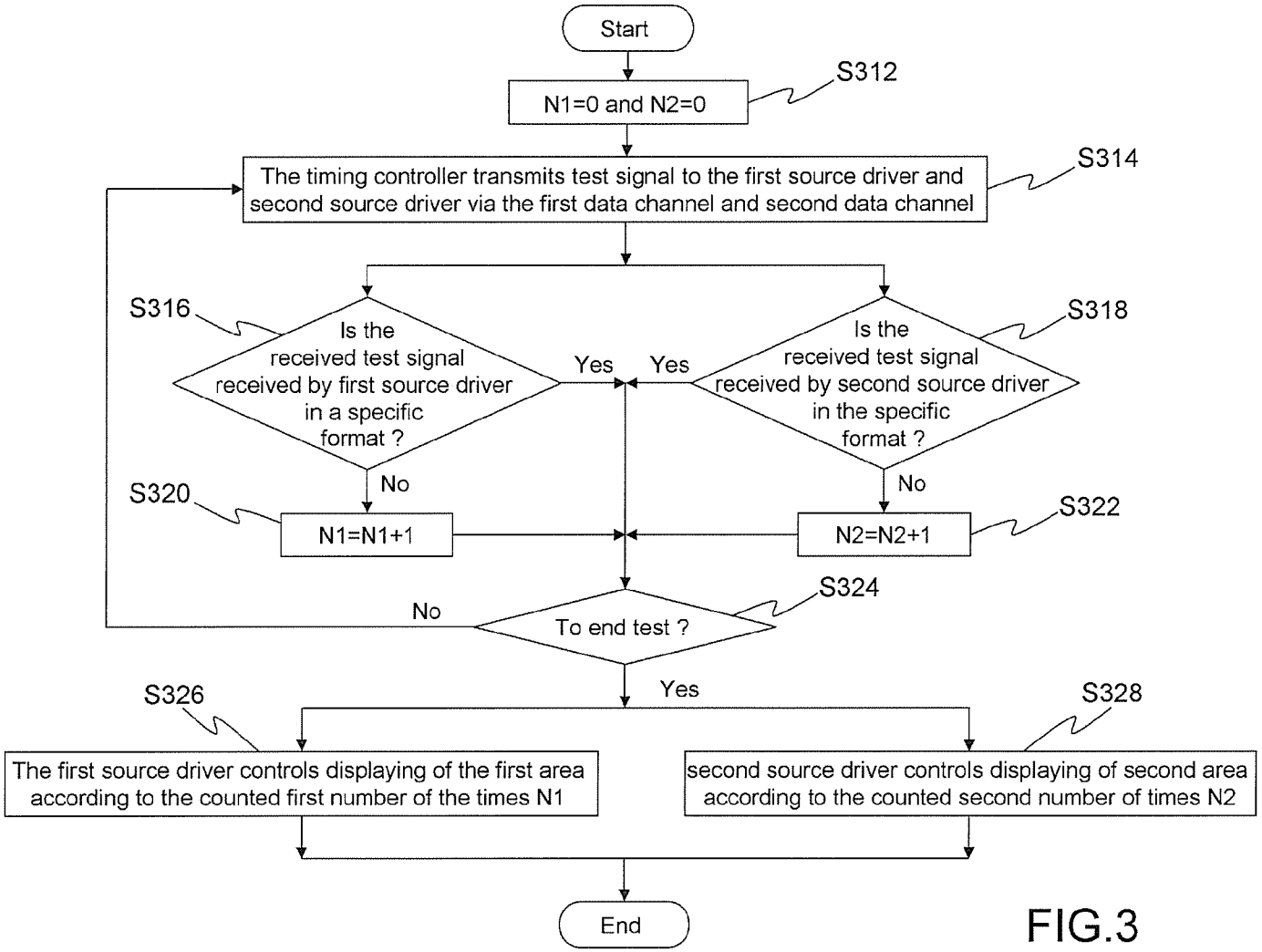
FIG. 3 is a flowchart illustrating displaying of the error rates of the data channels of the display in FIG. 1 according to a method of an embodiment of the invention.

Please refer to FIG. 1 and FIG. 3. FIG. 3 is a flowchart illustrating displaying of the error rates of the data channels of the display 100 in FIG. 1 according to a method of an embodiment of the invention. In step S312, the first source driver 130(1) sets the counted first number of times N1 to zero and the second source driver 130(2) sets the counted second number of times N2 to zero. In step S314, the timing controller 110 transmits the test signal $S_T$ to the first source driver 130(1) and the second source driver 130(2) via the first data channel 120(1) and the second data channel 120(2). Then, in steps S316 and S318, the first source driver 130(1) and the second source driver 130(2) respectively determine if the received test signal $S_T$ is in the specific format. When the first source driver 130(1) determines that the received test signal $S_T$ is not in the specific format, step S320 is executed so that one is added to the counted first number of times N1. Similarly, when the second source driver 130(2) determines that the received test signal $S_T$ is not in the specific format, step S322 is executed so that one is added to the counted second number of times N2. In step S324, the timing controller 110 determines whether to end the test, i.e. determines if the testing period $T_S$ has ended. If the test is not ended, the step S314 is repeated. Otherwise, steps S326 and S328 are executed. In the step S326, the first source driver 130(1) controls displaying of the first area 150(1) according to the counted first number of times N1. In the step S328, the second source driver 130(2) controls displaying of the second area 150(2) according to the counted second number of times N2.

Figure 4:
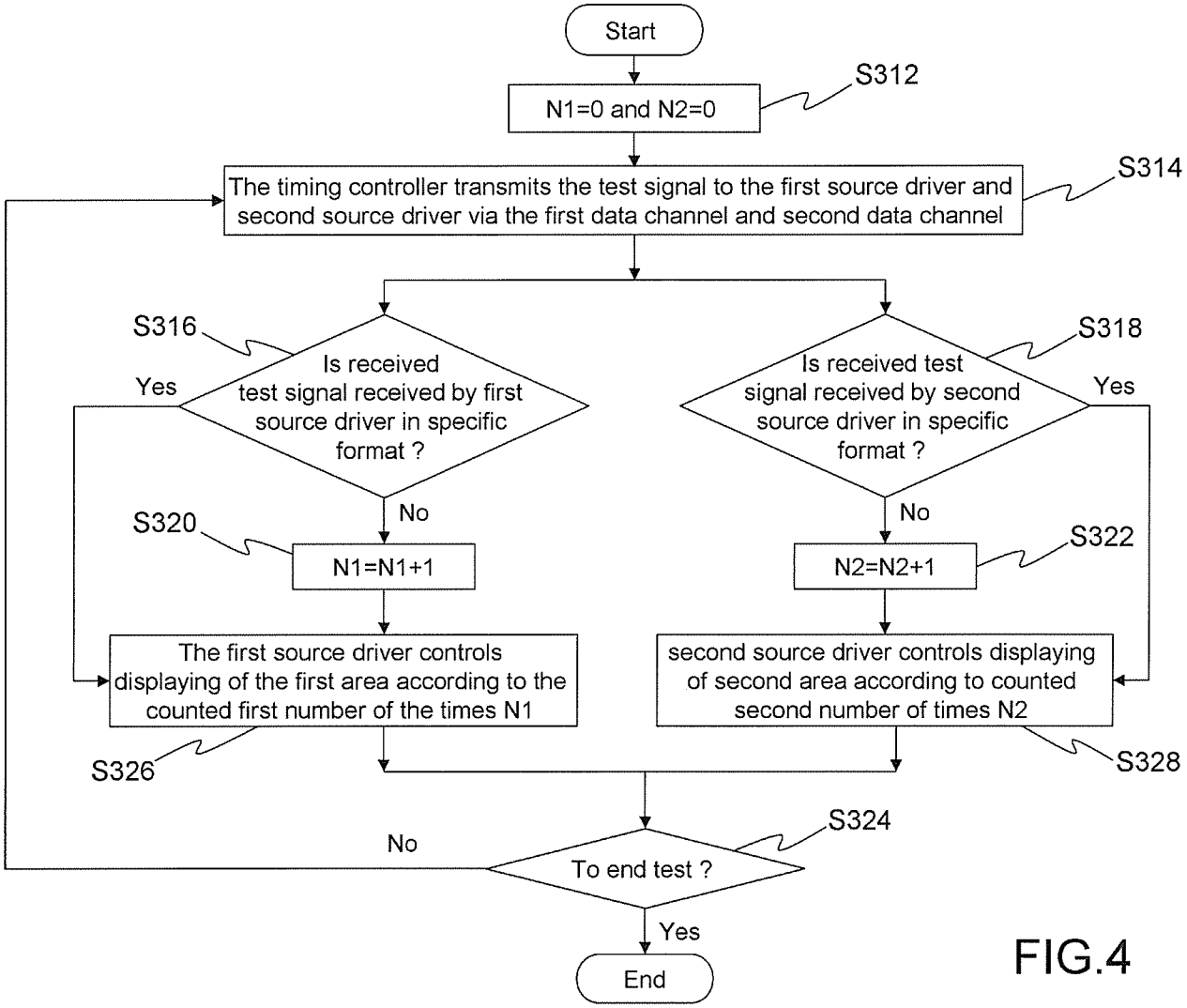
FIG. 4 is a flowchart illustrating displaying of the error rates of the data channels of the display in FIG. 1 according to a method of another embodiment of the invention.

Please refer to FIG. 1, FIG. 3 and FIG. 4. FIG. 4 is a flowchart illustrating displaying of the error rates of the data channels of the display 100 in FIG. 1 according to a method of an embodiment of the invention. The process in FIG. 4 differs from the process in FIG. 3 mainly in the sequence of execution of the steps S324, S326 and S328; the two processes are otherwise identical and description thereof will not be repeated. In the process in FIG. 4, when the step S316 or S320 ends, the step S326 is executed so that the first source driver 130(1) timely controls displaying of the first area 150(1) according to the counted first number of times N1. Similarly, when the step S318 or S322 ends, the step S328 is executed so that the second source driver 130(2) timely controls displaying of the second area 150(2) according to the counted second number of times N2. After the step S326 or S328 is executed, the step S324 is executed.

Figure 5:
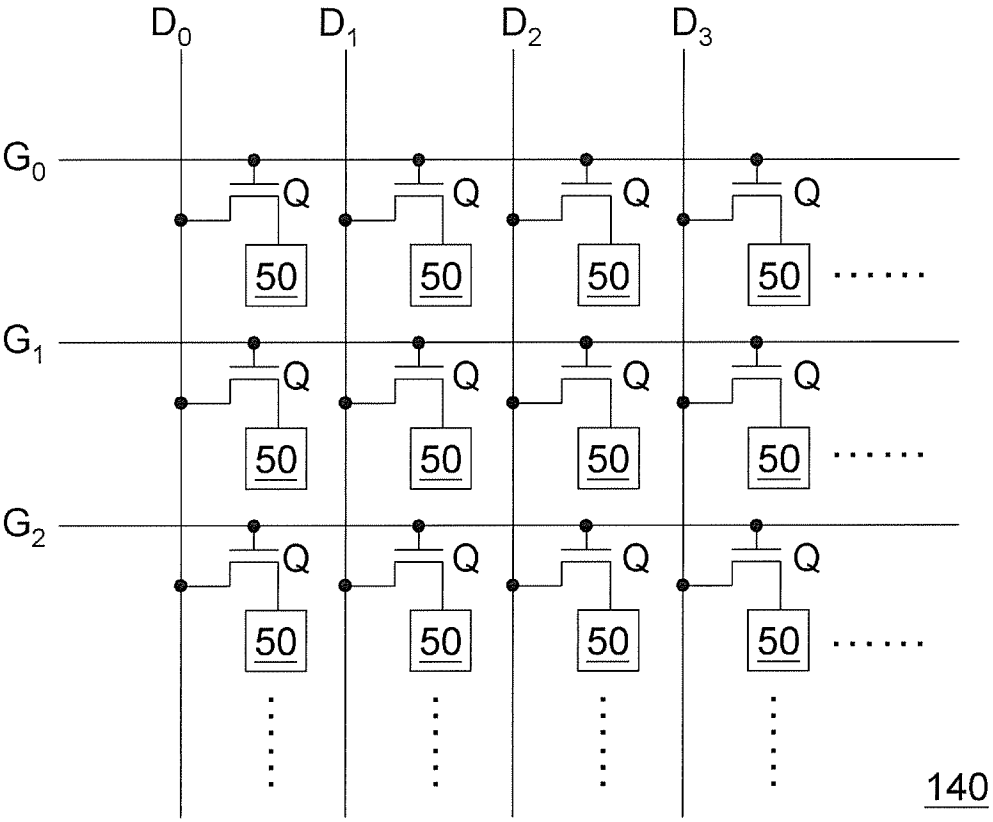
FIG. 5 is a schematic diagram of a panel according to an embodiment of the invention.

To more clearly explain the method for displaying error rates of data channels of the display employed in other embodiments of the invention, the method for driving the panel 140 is roughly described below. Please refer to FIG. 1 and FIG. 5. FIG. 5 is a schematic diagram of the panel 140 according to an embodiment of the invention. The panel 140 has a plurality of pixels 50, a plurality of data lines (e.g. $D_0$~$D_3$), a plurality of scan lines (e.g. $G_0$~$G_2$) and a plurality of transistors Q. Each pixel 50 is coupled to one end of the transistor Q, the data line (e.g. $D_0$~$D_3$) is coupled to the other end of the transistor Q, and a gate of the transistor Q is coupled to the scan line (e.g. $G_0$~$G_2$). In this embodiment, the panel 140 is a liquid crystal display panel. The source driver and a gate driver in the display drive the panel 140 respectively by transmitting a data voltage and a scan voltage. In addition, the first source driver 130(1) and the second source driver 130(2) are coupled to the pixels 50 via the data lines (e.g. $D_0$~$D_3$) of the panel 140, so as to transmit the data voltage to the pixels 50 via the data lines.

Figure 6:
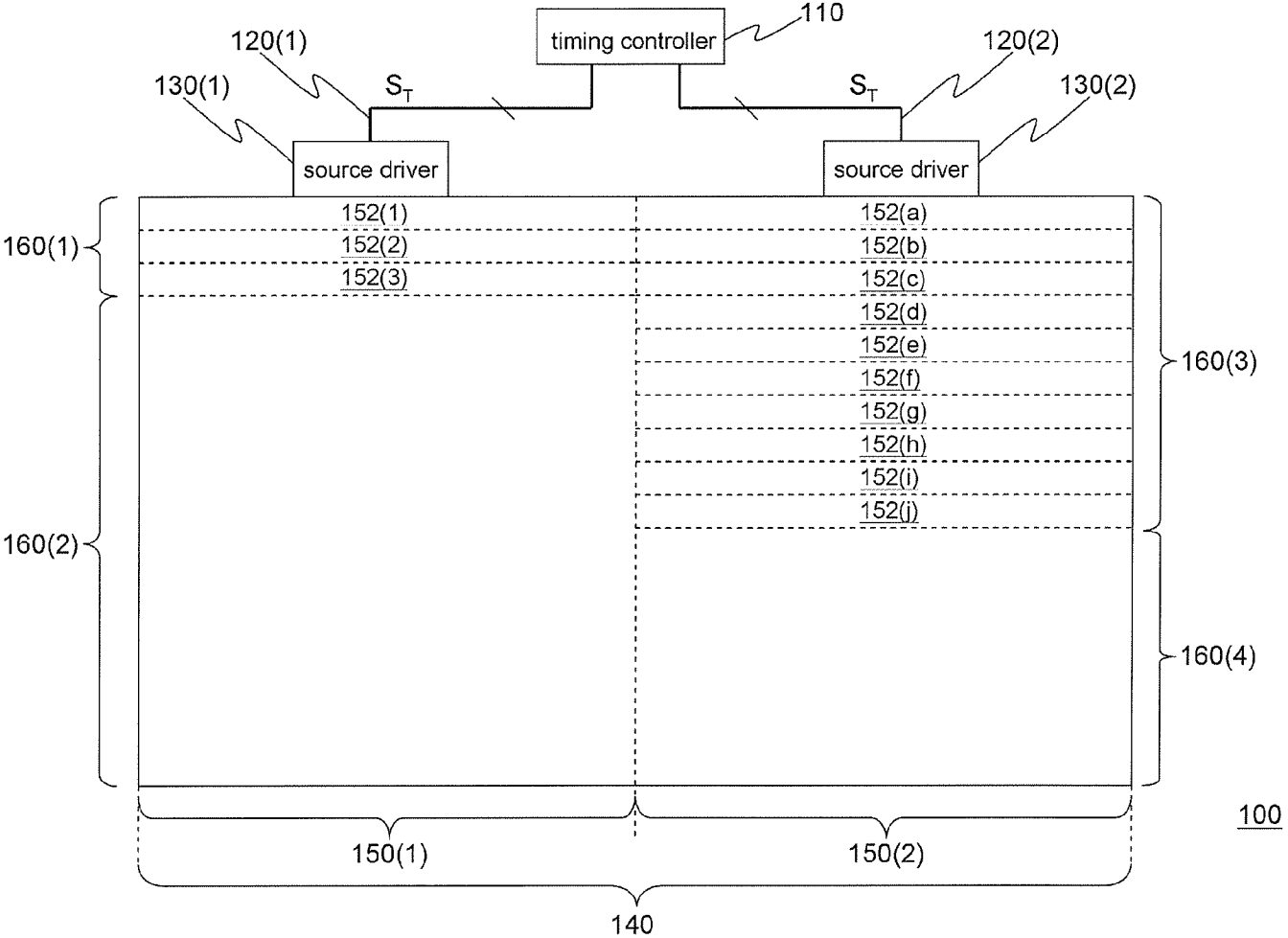
FIG. 6 is for demonstrating how error rates of data channels of a display 100 are displayed in an embodiment of the invention.

Please refer to FIG. 6. FIG. 6 is for demonstrating how the error rates of the data channels of the display 100 are displayed in an embodiment of the invention. In this embodiment, the first source driver 130(1) controls displaying of the first area 150(1) according to the counted first number of times N1, and the second source driver 130(2) controls displaying of the second area 150(2) according to the counted second number of times N2. The first area 150(1) includes a first sub-area 160(1) and a second sub-area 160(2), and the second area 150(2) includes a third sub-area 160(3) and a fourth sub-area 160(4). The first source driver 130(1) controls a size of the first sub-area 160(1) according to the counted first number of times N1, and the second source driver 150(2) controls a size of the third sub-area 160(3) according to the counted second number of times N2. When the counted first number of times N1 gets greater, which means a higher error rate of the first data channel 120(1), and thus the first sub-area 160(1) becomes larger while the second sub-area 160(2)

becomes smaller. Similarly, when the counted second number of times N2 gets greater, which means a higher error rate of the second data channel 120(2), and thus the third sub-area 160(3) becomes larger while the fourth sub-area 160(4) becomes smaller. Therefore, the error rates of the first data channel 120(1) and the second data channel 120(2) can be determined according to the sizes of the first sub-area 160(1) and the third sub-area 160(3).

In an embodiment of the invention, the first sub-area 160(1) and the third sub-area 160(3) respectively have a number of display rows (e.g. 152(1)~152(3) and 152(*a*)~152(*j*)), wherein the number is identical to the counted first number of times N1 or the counted second number of times N2. In other words, the number of the display rows which the first sub-area 160(1) has is equal to the counted first number of times N1, and the number of the display rows which the third sub-area 160(3) has is equal to the counted second number of times N2. For example, in FIG. 6, the counted first number of times N1 is equal to 3 and the counted second number of times N2 is equal to 10. Thus, an area ratio between the first sub-area 160(1) and the third sub-area 160(3) is equal to a ratio of the counted first number of times N1 to the counted second number of times N2. In addition, the vertical resolution of each of the display rows may be one or more pixels. In other words, all the pixels in each of the display rows are controlled by one or more scan lines.

In an embodiment of the invention, the first source driver 130(1) controls the first sub-area 160(1) and the second sub-area 160(2) to be displayed with different gray-level values, and the second source driver 130(2) controls the third sub-area 160(3) and the fourth sub-area 160(4) to be displayed with different gray-level values. In other words, the first sub-area 160(1) is displayed with a first gray-level value and the second sub-area 160(2) is displayed with a second gray-level value, wherein the first gray-level value is not equal to the second gray-level value. The third sub-area 160(3) is displayed with a third gray-level value and the fourth sub-area 160(4) is displayed with a fourth gray-level value, wherein the third gray-level value is not equal to the fourth gray-level value.

In an embodiment of the invention, the first source driver 130(1) controls the first sub-area 160(1) to be displayed with graded gray-level values, and the second source driver 130(2) controls the third sub-area 160(3) to be displayed with graded gray-level values. For example, if the gray-level values of the display rows 152(1)~152(3) in the first sub-area 160(1) are respectively G1, G2 and G3, and the gray-level values of the display rows 152(*a*)~152(*j*) in the third sub-area 160(3) are respectively Ga, Gb, Gc, Gd, Ge, Gf, Gg, Gh, Gi and Gj, G1<G2<G3 or G1>G2>G3. In addition, Ga<Gb<Gc<Gd<Ge<Gf<Gg<Gh<Gi<Gj, or Ga>Gb>Gc>Gd>Ge>Gf>Gg>Gh>Gi>Gj. In an embodiment of the invention, the gray-level value G1 is equal to the gray-level value Ga, the gray-level value G3 is equal to the gray-level value Gj, the gray-level value displayed by the second sub-area 160(2) is G3, and the gray-level value displayed by the fourth sub-area 160(4) is Gj.

In an embodiment of the invention, the first source driver 130(1) controls a color displayed by the first area 150(1) according to the counted first number of times N1, and the second source driver 130(2) controls a color displayed by the second area 150(2) according to the counted second number of times N2. Herein, the first source driver 130(1) controls the first sub-area 160(1) to be displayed with graded color-level values, and the second source driver 130(2) controls the third sub-area 160(3) to be displayed with graded color-level values. For example, if the color-level values of the display rows 152(1)~152(3) in the first sub-area 160(1) are respectively C1, C2 and C3, and the color-level values of the display rows 152(*a*)~152(*j*) in the third sub-area 160(3) are respectively Ca, Cb, Cc, Cd, Ce, Cf, Cg, Ch, Ci and Cj, C1<C2<C3 or C1>C2>C3. In addition, Ca<Cb<Cc<Cd<Ce<Cf<Cg<Ch<Ci<Cj, or Ca>Cb>Cc>Cd>Ce>Cf>Cg>Ch>Ci>Cj. In an embodiment of the invention, the color-level value displayed by the second sub-area 160(2) is C3, and the color-level value displayed by the fourth sub-area 160(4) is Cj.

Figure 7:
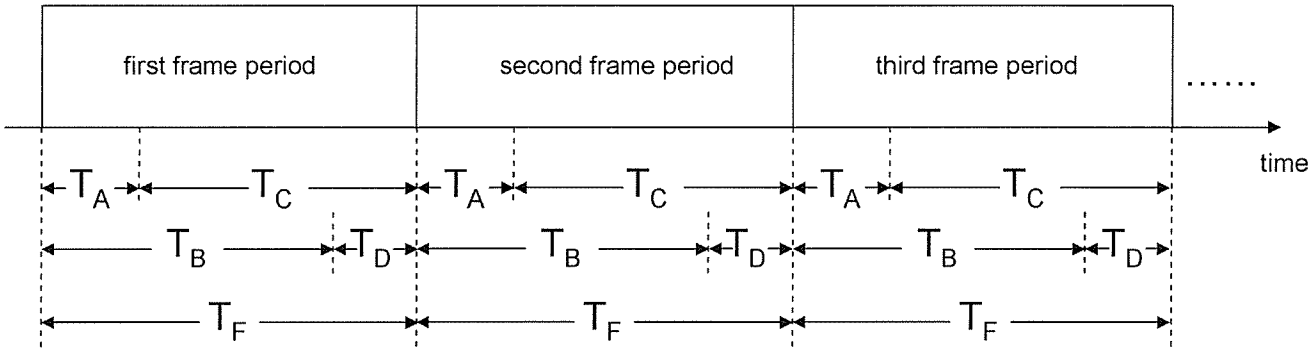
FIG. 7 is a timing diagram of a first and a second source drivers according to an embodiment of the invention.

In an embodiment of the invention, the first source driver 130(1) controls displaying of the first sub-area 160(1) during a first display period according to the counted first number of times N1. The second source driver 130(2) controls displaying of the third sub-area 160(3) during a second display period according to the counted second number of times N2. A ratio of the first display period to the second display period is equal to the ratio of the counted first number of times N1 to the counted second number of times N2. Please refer to FIG. 7. FIG. 7 is a timing diagram of the first source driver 130(1) and the second source driver 130(2) according to an embodiment of the invention. In each frame period $T_F$, the first source driver 130(1) and the second source driver 130(2) update once the screen displayed on the panel 140. The first source driver 130(1) controls displaying of the first sub-area 160(1) during a first display period $T_A$ according to the counted first number of times N1. The second source driver 130(2) controls displaying of the third sub-area 160(3) during a second display period $T_B$ according to the counted second number of times N2. A ratio of the first display period $T_A$ to the second display period $T_B$ is equal to the ratio of the counted first number of times N1 to the counted second number of times N2. In a state with a fixed scanning period, since the ratio of the first display period $T_A$ to the second display period $T_B$ is equal to the ratio of the counted first number of times N1 to the counted second number of times N2, the area ratio between the first sub-area 160(1) and the third sub-area 160(3) is equal to the ratio of the counted first number of times N1 to the counted second number of times N2. In addition, the first source driver 130(1) controls displaying of the second sub-area 160(2) during a third display period $T_C$, and the second source driver 130(2) controls displaying of the fourth sub-area 160(4) during a fourth display period $T_D$.

Figure 8:
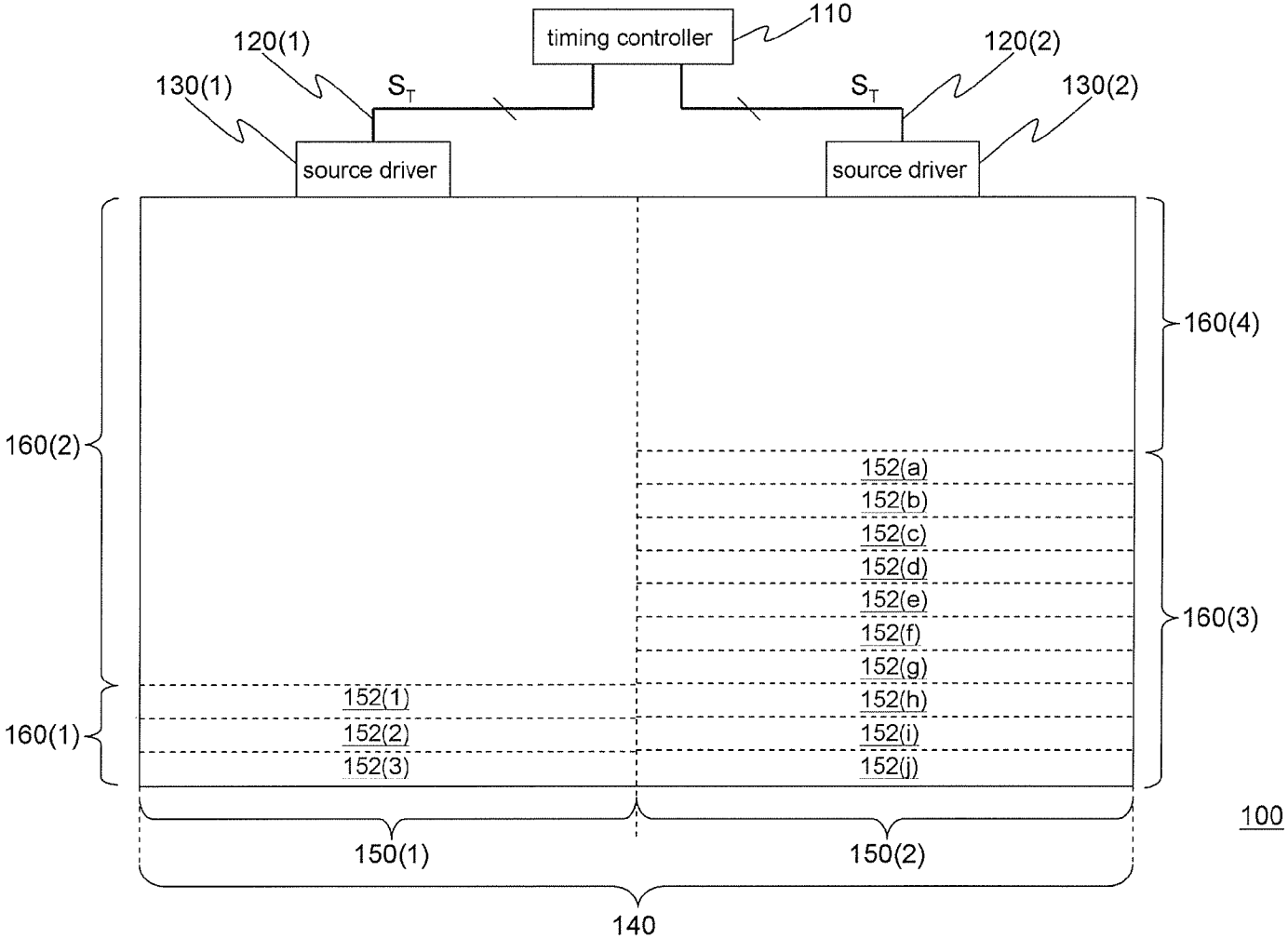
FIG. 8 is for demonstrating how error rates of data channels of a display are displayed in an embodiment of the invention.
Figure 9:
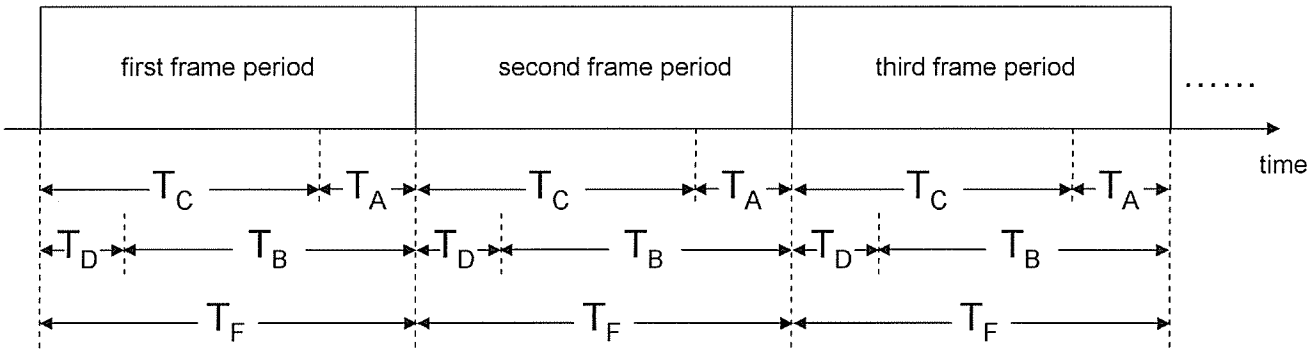
FIG. 9 is a timing diagram of the first and the second source drivers corresponding to the embodiment shown in FIG. 8.

In the embodiments in FIGS. 6 and 7, in each frame period $T_F$, the first source driver 130(1) first drives the first sub-area 160(1) and then drives the second sub-area 160(2), and the second source driver 130(2) first drives the third sub-area 160(3) and then drives the fourth sub-area 160(4). Nevertheless, the invention is not limited thereto. For example, in an embodiment of the invention, the first source driver 130(1) first drives the second sub-area 160(2) and then drives the first sub-area 160(1), and the second source driver 130(2) first drives the fourth sub-area 160(4) and then drives the third sub-area 160(3). Please refer to FIG. 8 and FIG. 9. FIG. 8 is for demonstrating how the error rates of the data channels of the display 100 are displayed in an embodiment of the invention. FIG. 9 is a timing diagram of the first source driver 130(1) and the second source driver 130(2) corresponding to the embodiment in FIG. 8. In each frame period $T_F$, the first display period $T_A$ follows behind the third display period $T_C$ in timing, and the second display period $T_B$ follows behind the fourth display period $T_D$ in timing. In addition, in each frame period $T_F$, the first source driver 130(1) first drives the second sub-area 160(2) during the third display period $T_C$ and then drives the first sub-area 160(1) during the first display period $T_A$, and the second source driver 130(2) first drives the fourth sub-area 160(4) during the fourth display period $T_D$ and then drives the third sub-area 160(3) during the second display period $T_B$.

Figure 10:
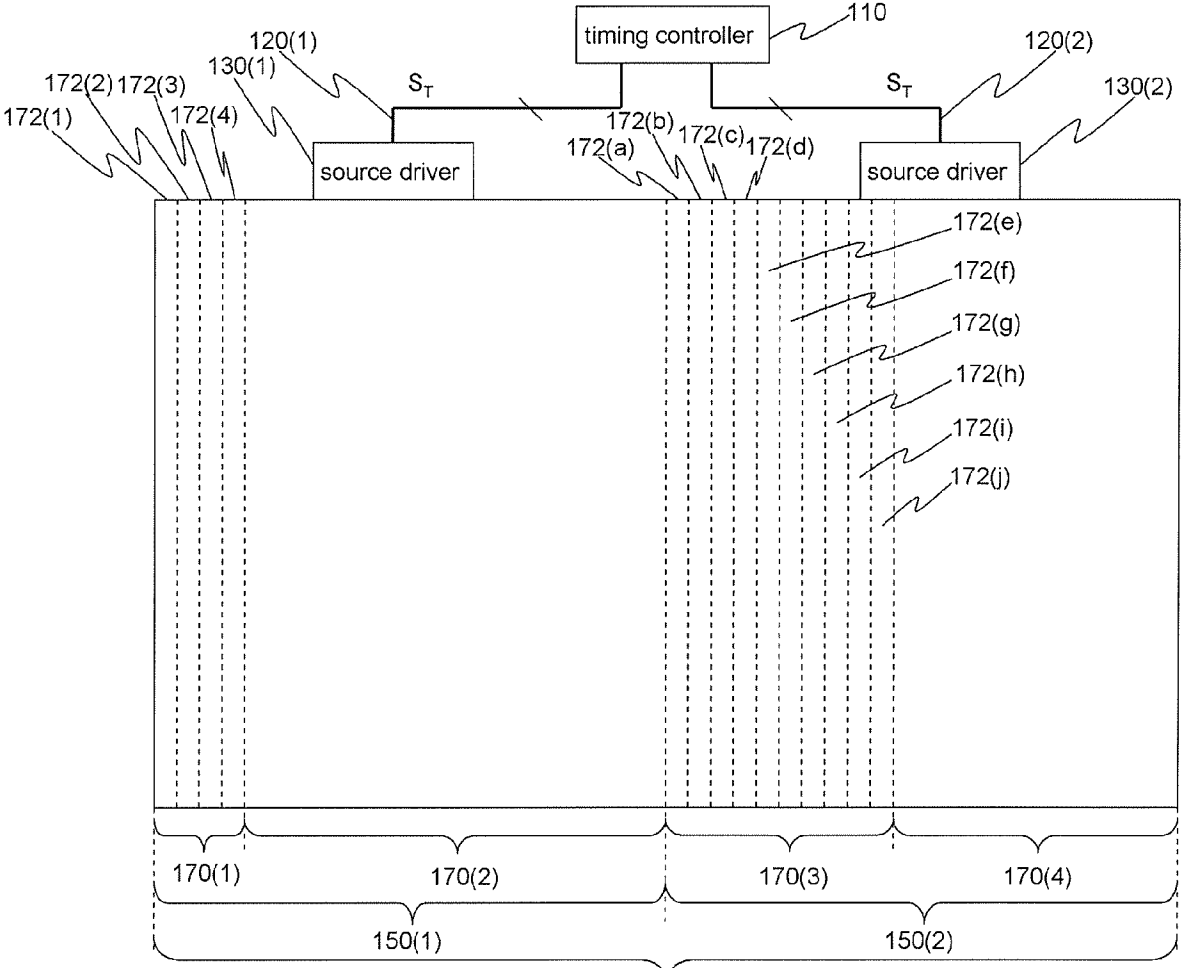
FIG. 10 is for demonstrating how error rates of data channels of a display are displayed in an embodiment of the invention.

Please refer to FIG. 10. FIG. 10 is for demonstrating how the error rates of the data channels of the display 100 are displayed in an embodiment of the invention. In this embodiment, the first source driver 130(1) controls displaying of the first area 150(1) according to the counted first number of times N1, and the second source driver 130(2) controls displaying of the second area 150(2) according to the counted second number of times N2. The first area 150(1) includes a first sub-area 170(1) and a second sub-area 170(2), and the second area 150(2) includes a third sub-area 170(3) and a fourth sub-area 170(4). The first sub-area 170(1) and the third sub-area 170(3) respectively have a number of display rows (e.g. 172(1)~172(4) and 172(*a*)~172(*j*)), wherein the number is identical to the counted first number of times N1 or the counted second number of times N2. In other words, the number of the display rows which the first sub-area 170(1) has is equal to the counted first number of times N1, and the number of the display rows which the third sub-area 170(3) has is equal to the counted second number of times N2. For example, in FIG. 10, the counted first number of times N1 is equal to 4 and the counted second number of times N2 is equal to 10. Thus, an area ratio between the first sub-area 170(1) and the third sub-area 170(3) is equal to the ratio of the counted first number of times N1 to the counted second number of times N2. In addition, the horizontal resolution of each of the display rows may be one or more pixels. In other words, all the pixels in each of the display rows are controlled by one or more data lines.

In an embodiment of the invention, the first source driver 130(1) controls a first number of the data lines (e.g. the data lines $D_0$~$D_3$ in FIG. 5) according to the counted first number of times N1 so as to control displaying of the first sub-area 170(1). The second source driver 130(2) controls a second number of the data lines according to the counted second number of times N2 so as to control displaying of the third sub-area 170(3). A ratio of the first number to the second number is equal to the ratio of the counted first number of times N1 to the counted second number of times N2.

In an embodiment of the invention, the first source driver 130(1) controls the first sub-area 170(1) and the second sub-area 170(2) to be displayed with different gray-level values, and the second source driver 130(2) controls the third sub-area 170(3) and the fourth sub-area 170(4) to be displayed with different gray-level values. In other words, the first sub-area 170(1) is displayed with a first gray-level value and the second sub-area 170(2) is displayed with a second gray-level value, wherein the first gray-level value is not equal to the second gray-level value. The third sub-area 170(3) is displayed with a third gray-level value and the fourth sub-area 170(4) is displayed with a fourth gray-level value, wherein the third gray-level value is not equal to the fourth gray-level value.

In an embodiment of the invention, the first source driver 130(1) controls the first sub-area 170(1) to be displayed with graded gray-level values, and the second source driver 130(2) controls the third sub-area 170(3) to be displayed with graded gray-level values. For example, if the gray-level values of the display rows 172(1)~172(4) in the first sub-area 170(1) are respectively G1, G2, G3 and G4, and the gray-level values of the display rows 172(*a*)~172(*j*) in the third sub-area 170(3) are respectively Ga, Gb, Gc, Gd, Ge, Gf, Gg, Gh, Gi and Gj, G1<G2<G3<G4 or G1>G2>G3>G4. In addition, Ga<Gb<Gc<Gd<Ge<Gf<Gg<Gh<Gi<Gj, or Ga>Gb>Gc>Gd>Ge>Gf>Gg>Gh>Gi>Gj. In an embodiment of the invention, the gray-level value G1 is equal to the gray-level value Ga, the gray-level value G3 is equal to the gray-level value Gj, the gray-level value displayed by the second sub-area 170(2) is G3, and the gray-level value displayed by the fourth sub-area 170(4) is Gj.

In an embodiment of the invention, the first source driver 130(1) controls a color displayed by the first area 150(1) according to the counted first number of times N1, and the second source driver 130(2) controls a color displayed by the second area 150(2) according to the counted second number of times N2. The first source driver 130(1) controls the first sub-area 170(1) to be displayed with graded color-level values, and the second source driver 130(2) controls the third sub-area 170(3) to be displayed with graded color-level values. For example, if the color-level values of the display rows 172(1)~172(4) in the first sub-area 170(1) are respectively C1, C2, C3 and C4, and the color-level values of the display rows 172(*a*)~172(*j*) in the third sub-area 170(3) are respectively Ca, Cb, Cc, Cd, Ce, Cf, Cg, Ch, Ci and Cj, C1<C2<C3<C4 or C1>C2>C3>C4. In addition, Ca<Cb<Cc<Cd<Ce<Cf<Cg<Ch<Ci<Cj, or Ca>Cb>Cc>Cd>Ce>Cf>Cg>Ch>Ci>Cj. In an embodiment of the invention, the color-level value displayed by the second sub-area 170(2) is C3 and the color-level value displayed by the fourth sub-area 170(4) is Cj.

Figure 11:
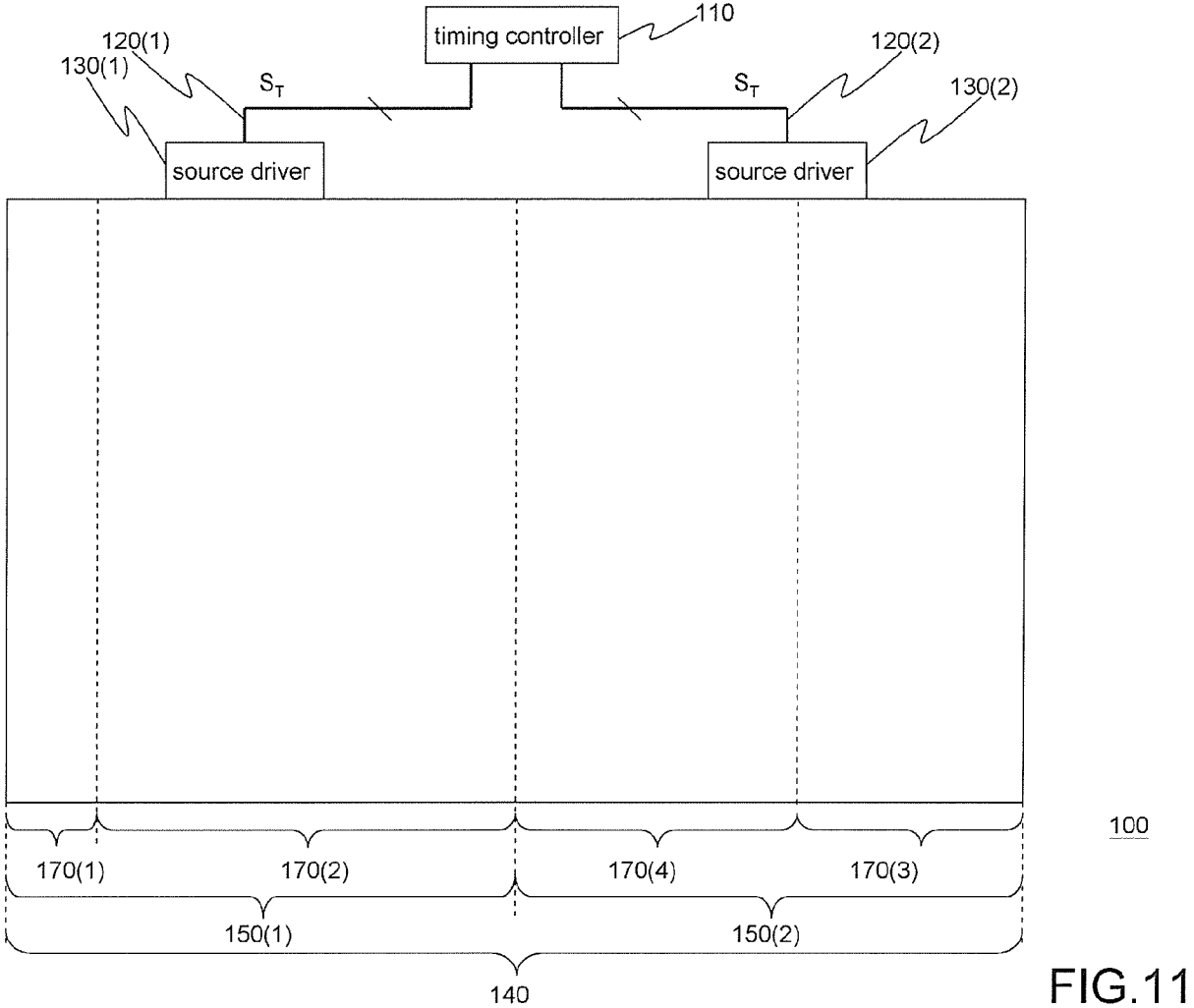
FIG. 11 is for demonstrating how error rates of data channels of a display are displayed in another embodiment of the invention.
Figure 12:
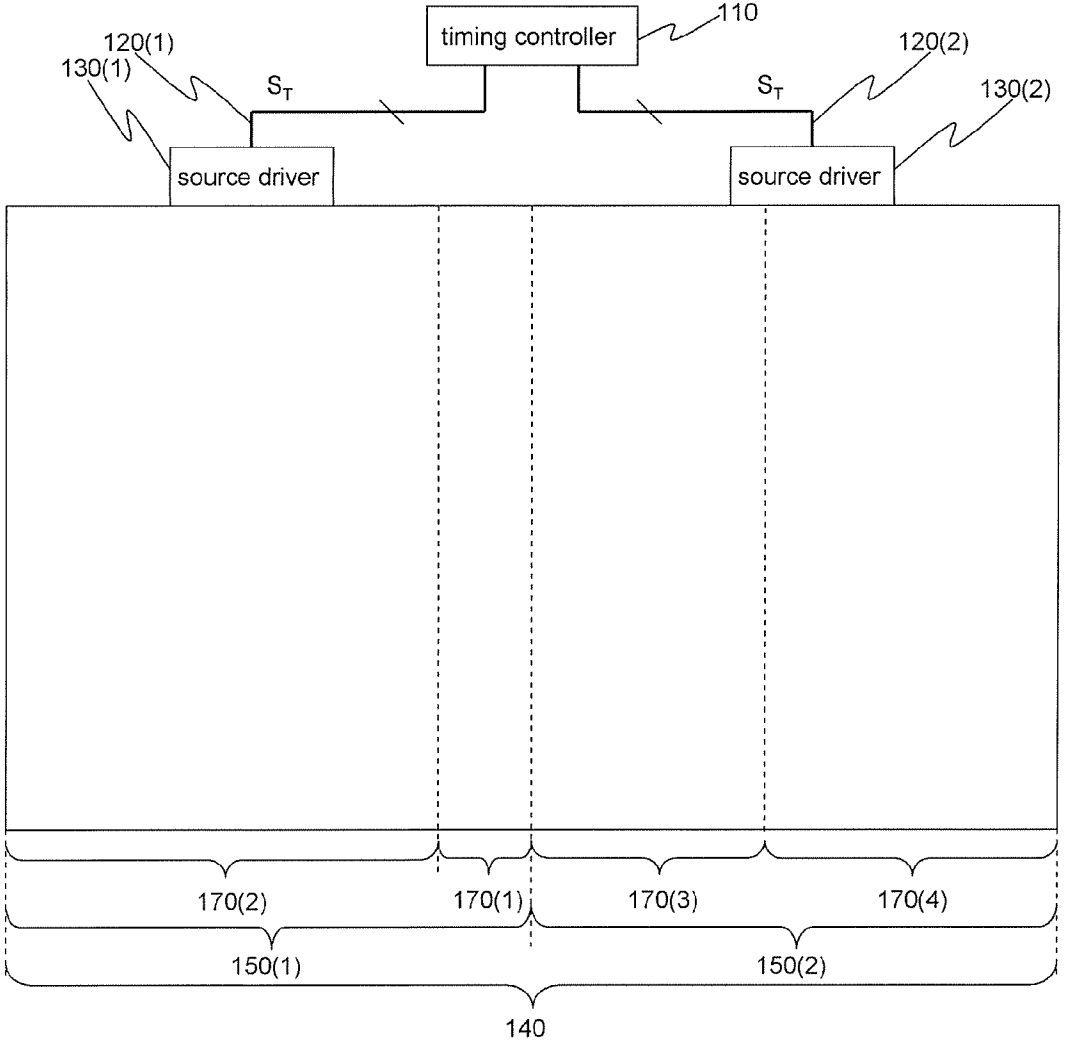
FIG. 12 is for demonstrating how error rates of data channels of a display are displayed in still another embodiment of the invention.
Figure 13:
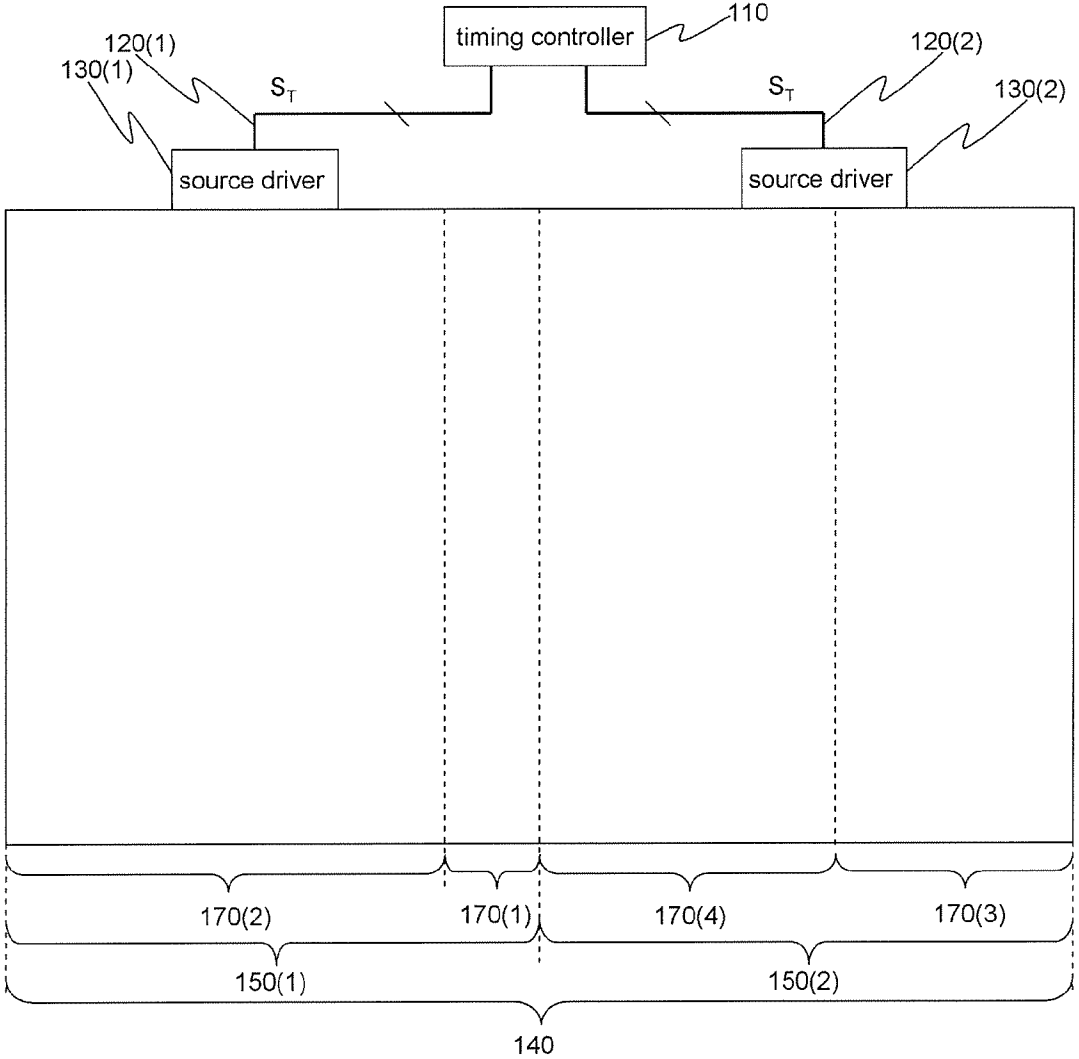
FIG. 13 is for demonstrating how error rates of data channels of a display are displayed in yet still another embodiment of the invention.

In the embodiment in FIG. 10, the first sub-area 170(1) is located at the left side of the second sub-area 170(2), and the third sub-area 170(3) is located at the left side of the fourth sub-area 170(4). Nevertheless, the invention is not limited thereto. For example, in an embodiment of the invention, the first sub-area 170(1) is located at the left side of the second sub-area 170(2), and the third sub-area 170(3) is located at the right side of the fourth sub-area 170(4), as shown in FIG. 11. Also, as shown in FIG. 12, the first sub-area 170(1) is located at the right side of the second sub-area 170(2), and the third sub-area 170(3) is located at the left side of the fourth sub-area 170(4). Also, as shown in FIG. 13, the first sub-area 170(1) is located at the right side of the second sub-area 170(2), and the third sub-area 170(3) is located at the right side of the fourth sub-area 170(4).

Figure 14:
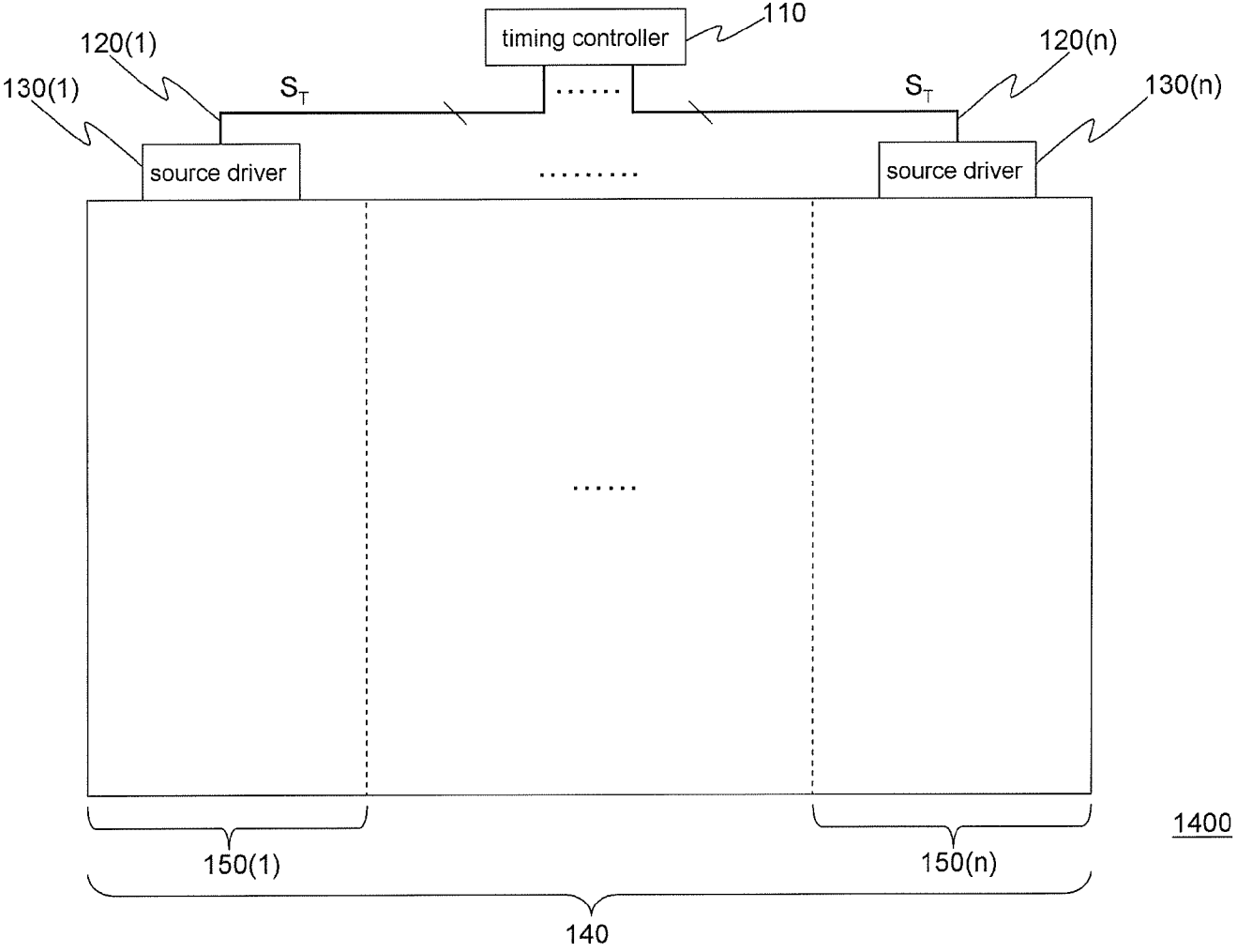
FIG. 14 is for demonstrating how error rates of data channels of a display having a plurality of source drivers are displayed in an embodiment of the invention.

It should be noted that though only two source drivers are described in the above embodiments, the invention is applicable to displays having three or more source drivers. Please refer to FIG. 14. FIG. 14 is for demonstrating how error rates of data channels of a display 1400 having a plurality of source drivers are displayed in an embodiment of the invention. The display 1400 has a plurality of data channels 120(1)~120(*n*) and a plurality of source drivers 130(1)~130(*n*), wherein n≥3. Each of the source drivers 130(1)~130(*n*) is coupled to the timing controller 110 via a corresponding data channel among the data channels 120(1)~120(*n*), so as to receive the test signal $S_T$ as well as relevant clock signal and data signal from the timing controller 110. During the testing period $T_S$, the timing controller 110 repeatedly transmits the test signal $S_T$ to the source drivers 130(1)~130(*n*) via the data channels 120(1)~120(*n*). The source drivers 130(1)~130(*n*) respectively determine if the received test signal $S_T$ is in the specific format, and respectively count numbers of times the test signal $S_T$ is determined not in the specific format. Next, the source drivers 130(1)~130(*n*) respectively control displaying of the corresponding areas 150(1)~150(*n*), according to the counted numbers of times.

When the display presents the error rates corresponding to each data channel, the tester may adjust parameters of the data channels based on the displayed error rates, such that the adjusted error rates of the data channels are reduced to meet a preset specification. The aforementioned methods for adjusting the parameters of the data channels include, but are not limited to, adjusting terminal resistance values of the data channels, adjusting sizes of equalizers of the data channels, and adjusting currents of receivers of the data channels.

In summary, the invention is by transmitting a test signal with a specific format to a plurality of source drivers of a display so that the source drivers determine the error rates of the plurality of data channels of the display according to the received test signal and control a panel of the display to present the error rates of the data channels in a way that the error rates are easily recognized.

Although the invention has been described with reference to the above embodiments, it is apparent to one of the ordinary skill in the art that modifications to the described embodiments may be made without departing from the spirit of the invention. Accordingly, the scope of the invention will be defined by the attached claims not by the above detailed descriptions.

What is claimed is:

1. A method for displaying error rates of data channels of a display, comprising:

repeatedly transmitting a test signal in a specific format to a first and a second source drivers of the display via a first and a second data channels of the display during a test period by a timing controller of the display, wherein the test signal in the specific format is a series of bits;

receiving the test signal respectively from the first and the second data channels, and determining whether the received test signal is in the specific format or not by the first and the second source drivers;

counting a first number and a second number of times, respectively by the first source driver and the second source driver, that the first source driver and the second source driver determine that the received test signal is not in the specific format during the testing period;

controlling displaying of a first area of a panel of the display according to the counted first number of times by the first source driver; and controlling displaying of a second area of the panel according to the counted second number of times by the second source driver.

2. The method of claim 1, wherein the first area comprises a first sub-area and a second sub-area and wherein the second area comprises a third sub-area and a fourth sub-area, the first source driver controlling a size of the first sub-area according to the counted first number of times, the second source driver controlling a size of the third sub-area according to the counted second number of times.

3. The method of claim 2, wherein an area ratio between the first sub-area and the third sub-area is equal to a ratio of the counted first number of times to the counted second number of times.

4. The method of claim 2, wherein the first source driver controls the first sub-area and the second sub-area to be displayed with different gray-level values, and the second source driver controls the third sub-area and the fourth sub-area to be displayed with different gray-level values.

5. The method of claim 2, wherein the first source driver controls the first sub-area to be displayed with graded gray-level values, and the second source driver controls the third sub-area to be displayed with graded gray-level values.

6. The method of claim 2, wherein the panel comprises a plurality of pixels and a plurality of data lines, the first and the second source drivers are coupled to the plurality of pixels via the plurality of data lines, the first source driver controls displaying of the first sub-area during a first display period according to the counted first number of times, the second source driver controls displaying of the third sub-area during a second display period according to the counted second number of times, a ratio of the first display period to the second display period is equal to the ratio of the counted first number of times to the counted second number of times.

7. The method of claim 2, wherein the panel comprises a plurality of pixels and a plurality of data lines, the first source driver controls a first number of the data lines according to the counted first number of times to control displaying of the first sub-area, the second source driver controls a second number of the data lines according to the counted second number of times to control displaying of the third sub-area, a ratio of the first number to the second number of the data lines is equal to the ratio of the counted first number of times to the counted second number of times.

8. The method of claim 1, wherein the first source driver controls a color displayed by the first area according to the counted first number of times, and the second source driver controls a color displayed by the second area according to the counted second number of times.

9. The method of claim 8, wherein the first area comprises a first sub-area and a second sub-area and the second area comprises a third sub-area and a fourth sub-area, and the first source driver controls the first sub-area to be displayed with graded color-level values, and the second source driver controls the third sub-area to be displayed with graded color-level values.

10. The method of claim 9, wherein the panel comprises a plurality of pixels and a plurality of data lines, the first and the second source drivers is coupled to the plurality of pixels via the plurality of data lines, the first source driver controls displaying of the first sub-area during a first display period according to the counted first number of times, the second source driver controls displaying of the third sub-area during a second display period according to the counted second number of times, a ratio of the first display period to the second display period is equal to the ratio of the counted first number of times to the counted second number of times.

11. The method of claim 9, wherein the panel comprises a plurality of pixels and a plurality of data lines, the first source driver controls a first number of the data lines according to the counted first number of times to control displaying of the first sub-area, the second source driver controls a second number of the data lines according to the counted second number of times to control displaying of the third sub-area, a ratio of the first number to the second number of the data lines is equal to the ratio of the counted first number of times to the counted second number of times.

12. The method of claim 1, wherein the test signal has a specific waveform.

13. The method of claim 1, wherein the test signals $S_{T(1)}$ $S_{T(2)}$ $S_{T(3)}$ $S_{T(4)}$ to $S_{T(N)}$, which are transmitted during the test period, corresponding to a continuous sequence are specifically coded and $S_{T(1)}=S_{T(2)}=S_{T(3)}=S_{T(4)} \ldots =S_{T(N)}$.

14. The method of claim 1, wherein the test signals $S_{T(1)}$ $S_{T(2)}$ $S_{T(3)}$ $S_{T(4)}$ to $S_{T(N)}$, which are transmitted during the test period, corresponding to a continuous sequence are specifically coded and $S_{T(1)}\neq S_{T(2)}\neq S_{T(3)}\neq S_{T(4)} \ldots \neq S_{T(N)}$.

* * * * *